US010023449B1

(12) United States Patent
Knoll

(10) Patent No.: US 10,023,449 B1
(45) Date of Patent: Jul. 17, 2018

(54) SKID LOADER ATTACHMENT

(71) Applicant: Douglas G. Knoll, Delano, MN (US)

(72) Inventor: Douglas G. Knoll, Delano, MN (US)

( * ) Notice: Subject to any disclaimer, the term of this patent is extended or adjusted under 35 U.S.C. 154(b) by 0 days.

(21) Appl. No.: 15/684,668

(22) Filed: Aug. 23, 2017

Related U.S. Application Data

(62) Division of application No. 14/885,391, filed on Oct. 16, 2015, now abandoned.

(60) Provisional application No. 62/064,820, filed on Oct. 16, 2014.

(51) Int. Cl.
*B66F 9/14* (2006.01)

(52) U.S. Cl.
CPC ..... *B66F 9/142* (2013.01)

(58) Field of Classification Search
CPC .. B66F 9/142; B66F 9/144; B66F 9/12; B66F 9/16; B66F 9/18
See application file for complete search history.

(56) References Cited

U.S. PATENT DOCUMENTS

| | | | | |
|---|---|---|---|---|
| 2,839,257 | A | 6/1958 | Chicane | |
| 2,912,183 | A | 11/1959 | Hull | |
| 2,914,270 | A | 11/1959 | Parker et al. | |
| 3,048,348 | A | 8/1962 | Griffin | |
| 3,851,779 | A | 12/1974 | Crawford | |
| 4,333,250 | A | 6/1982 | Henderson | |
| 4,473,196 | A | 9/1984 | Sammann et al. | |
| 4,930,718 | A | 6/1990 | Lancour et al. | |
| 5,246,182 | A | 9/1993 | Lester | |
| 5,385,314 | A | 1/1995 | Hughes | |
| 5,388,782 | A | 2/1995 | King | |
| 5,582,216 | A | 12/1996 | Smith et al. | |
| 5,897,288 | A | 4/1999 | Green | |
| 6,016,986 | A | 1/2000 | Wright | |
| 6,042,046 | A | 3/2000 | Beyer, Sr. | |
| 6,503,326 | B1 | 1/2003 | Mikelionis | |
| 6,543,713 | B1 | 4/2003 | Frolander et al. | |
| 6,672,823 | B2 * | 1/2004 | Henning | B66F 9/143 414/667 |
| 6,881,023 | B1 | 4/2005 | Sullivan | |
| 8,899,906 | B2 | 12/2014 | Peschel | |
| 2008/0232944 | A1 | 9/2008 | Kim | |
| 2010/0101895 | A1 | 4/2010 | Collins et al. | |
| 2013/0028696 | A1 | 1/2013 | Peschel et al. | |

* cited by examiner

*Primary Examiner* — Mark C Hageman
(74) *Attorney, Agent, or Firm* — Hall Estill Attorneys at Law

(57) ABSTRACT

An apparatus generally directed to a skid loader attachment, which includes at least, but is not limited to, a universal mounting structure, a pair of slide shaft support flanges secured to and protruding from a proximal end of the universal mounting structure, a slide shaft attached to and disposed between the pair of slide shaft support flanges, the slide shaft spaced apart from and in non-contact adjacency with the universal mounting structure, and a tine adjustment structure secured to and protruding from a distal end of the universal mounting structure.

17 Claims, 6 Drawing Sheets

SKID LOADER ATTACHMENT

RELATED APPLICATIONS

This application is a divisional of copending U.S. patent application Ser. No. 14/885,391 filed Oct. 16, 2015, entitled "Skid Loader Attachment," which claims domestic priority to U.S. Provisional Application No. 62/064,820 filed Oct. 16, 2014, entitled "Skid Loader Attachment."

SUMMARY OF THE INVENTION

In a preferred embodiment, an apparatus is generally directed to a skid loader attachment, which includes at least, but is not limited to, a universal mounting structure, a pair of slide shaft support flanges secured to and protruding from a proximal end of the universal mounting structure, a slide shaft attached to and disposed between the pair of slid shaft support flanges, the slide shaft spaced apart from and in non-contact adjacency with the universal mounting structure, and a tine adjustment structure secured to and protruding from a distal end of the universal mounting structure.

BRIEF DESCRIPTION OF THE DRAWINGS

The patent or application file contains at least one drawing executed in color. Copies of this patent with color drawing(s) will be provided by the Patent and Trademark Office upon request and payment of necessary fee.

DETAILED DESCRIPTION

The present disclosure generally relates to a skid loader attachment. The apparatus preferably includes: A skid loader attachment comprising, a universal mounting structure, a pair of slide shaft support flanges secured to and protruding from a proximal end of the universal mounting structure, a slide shaft attached to and disposed between the pair of slide shaft support flanges, the slide shaft spaced apart from and in non-contact adjacency with the universal mounting structure, and a tine adjustment structure secured to and protruding from a distal end of the universal mounting structure. In an alternate preferred embodiment, a method of making the skid loader attachment preferably includes: a method of making skid loader attachment by steps comprising, providing a universal mounting structure, securing a pair of slide shaft support flanges to a proximal end of the universal mounting structure, the slide shaft support flanges protruding from the proximal end of the universal mounting structure, attaching a slide shaft to and disposed between the pair of slide shaft support flanges, the slide shaft spaced apart from and in non-contact adjacency with the universal mounting structure, and securing a tine adjustment structure to a distal end of the universal mounting structure, the tine adjustment member protruding from the distal end of the universal mounting structure.

Figure 1:
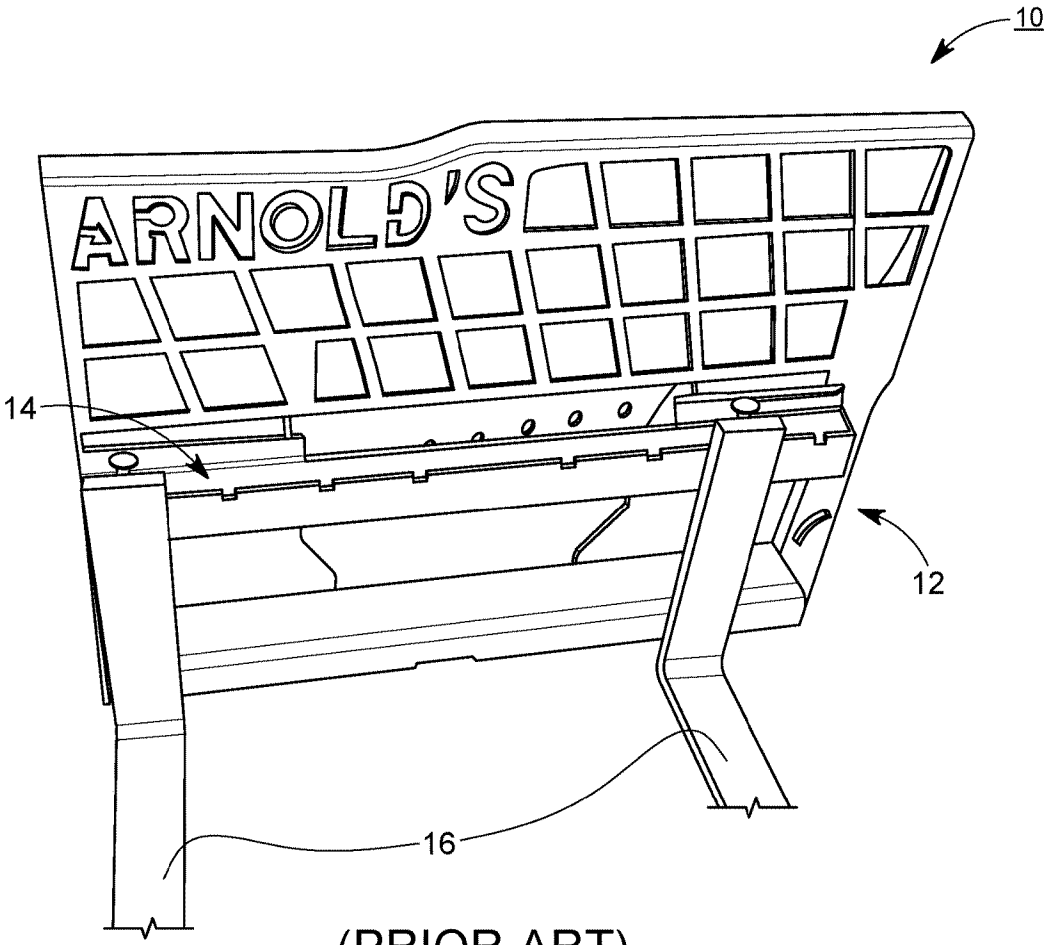
(PRIOR ART) FIG. 1
FIG. 1 is a front perspective view, of a prior art skid loader attachment.

Turning to the drawings, FIG. 1 depicts a prior art skid loader attachment 10 having: a universal mounting structure 12; a tine securement and adjustment structure 14, attached directly to a proximal end of the universal mounting structure 12; and a pair of tines 16 in sliding contact with the tine securement and adjustment structure 14.

Figure 2:
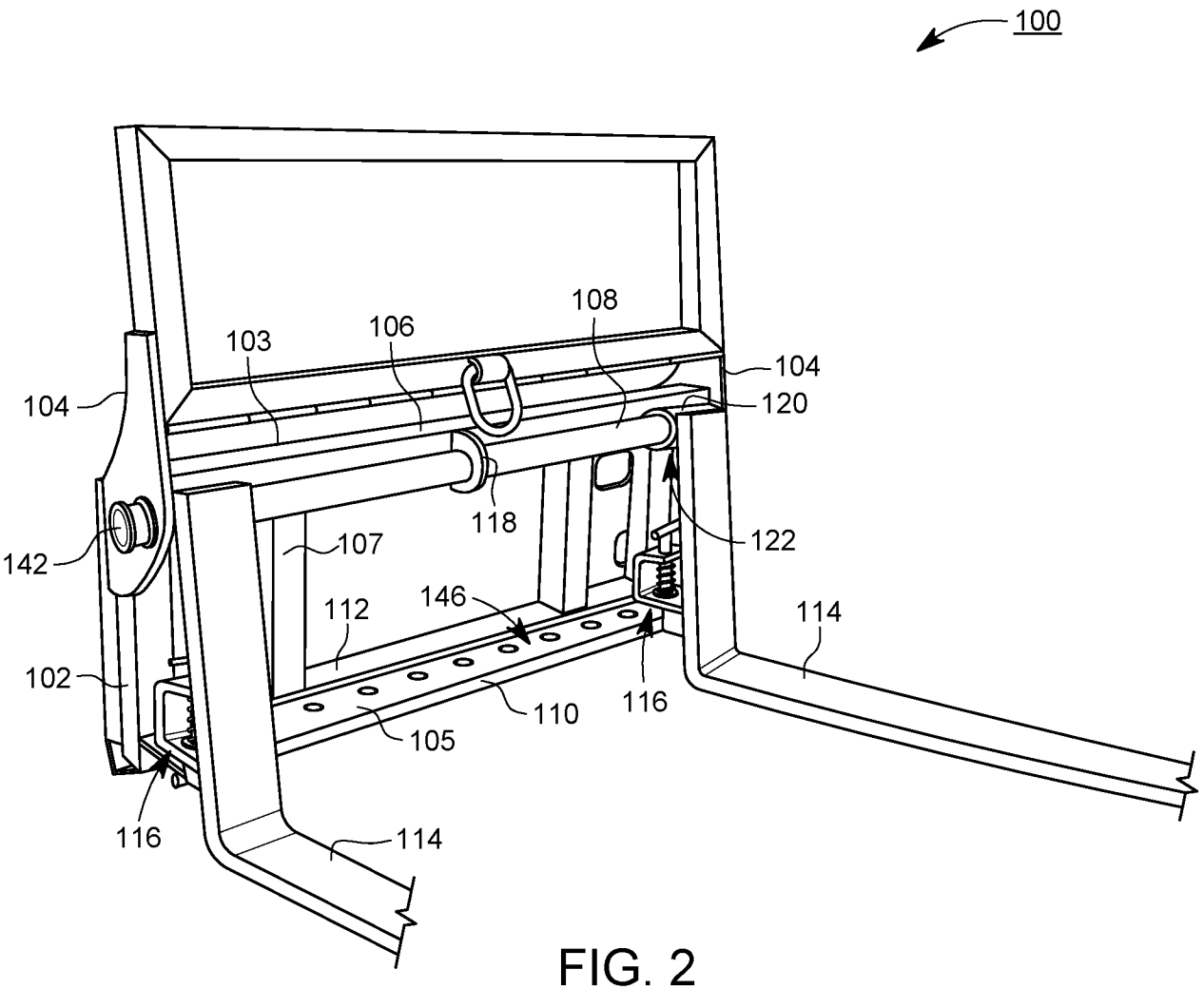
FIG. 2 shows a front perspective view in elevation of the inventive skid loader attachment.

FIG. 2 shows a skid loader attachment 100, which preferably includes at least, but is not limited to: a universal mounting structure 102, which preferably includes an upper portion 103, a lower portion 105, and a main body 107; a pair of slide shaft support flanges 104, secured to and protruding slightly forward and upward from a proximal end 106 of the universal mounting structure 102; a slide shaft 108, attached to and disposed between the pair of slide shaft support flanges 104, the slide shaft 108 is preferably spaced apart from, and in non-contact adjacency with, the universal mounting structure 102. The skid loader attachment 100, further preferably includes a tine adjustment structure 110, secured to and protruding from a distal end 112, of the universal mounting structure 102, and a pair of tines 114, constrained by and in sliding communication with the slide shaft 108.

In a preferred embodiment, the skid loader attachment 100, additionally includes at least, but is not limited to, a pair of constraint structures 116, which are preferably fastened to each tine 114 and cooperating with the tine adjustment structure 110. In a preferred embodiment, the tine adjustment structure 110, provides a plurality of alignment apertures 146 (of FIG. 5), which cooperate with the constraint structure 116 to secure a position of each tine relative to a horizontal midline of the universal mounting structure 102, which coincides with a shaft support structure 118.

The shaft support structure 118, is preferably secured to the universal mounting structure 102, supports the slide shaft 108, and encloses a midpoint of the slide shaft 108.

Vertically distal from the constraint structure 116, and secured to each tine 114 is preferably a tine support structure 120, which supports a slide shaft bushing 122. The tine support structure 120 encloses the slide shaft bushing 122, and the slide shaft bushing 122 is in contact sliding adjacency with the slide shaft 108.

Figure 3:
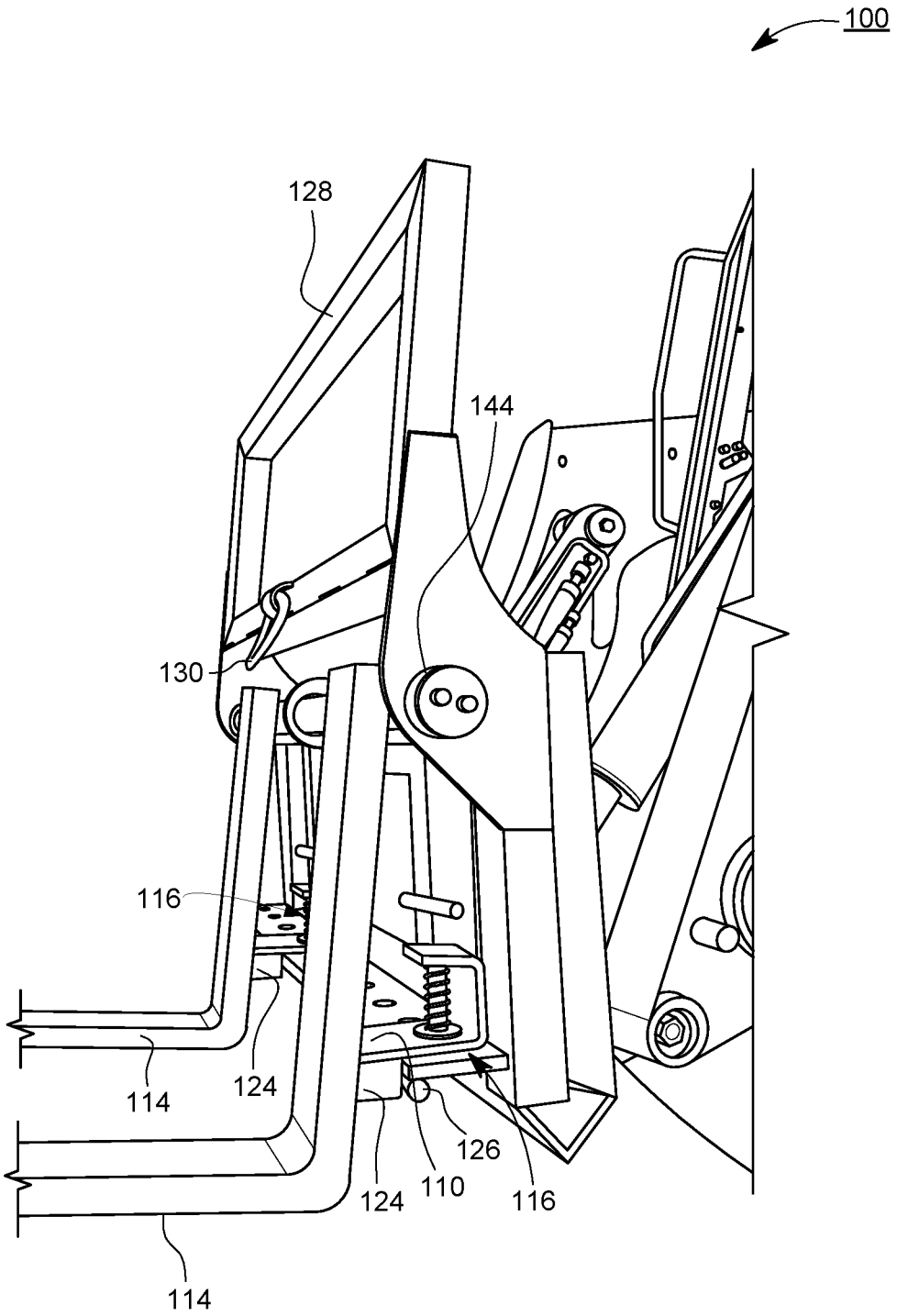
FIG. 3 displays a right side view of the inventive skid loader attachment of FIG. 2.

FIG. 3 shows the inventive skid loader attachment 100, further preferably includes tine standoff 124 secured to each tine 114, and to each constraint structure 116. FIG. 3 further shows that the tine adjustment structure 110 provides a buck rail 126, upon which the standoffs 124 ride during tine width adjustments operations. Each tine standoff 124 promotes a proper vertical alignment of each tine 114, relative to the universal mounting structure 102, and eliminates wear of each tine during the operation of the inventive skid loader attachment 100.

Continuing with FIG. 3, shown therein is a load restraint 128, secured to the pair of slide shaft support flanges 104, and extending vertically from the pair of slide shaft support flanges 104. Preferably, the load restraint 128 provides a shackle 130. The load restraint 128 mitigates loads carried on the tines 114 from intruding into the cockpit of the skid loader attachment 100, while the shackle 130, is provided as a tie down point for securing loads, as may be desired.

Figure 4:
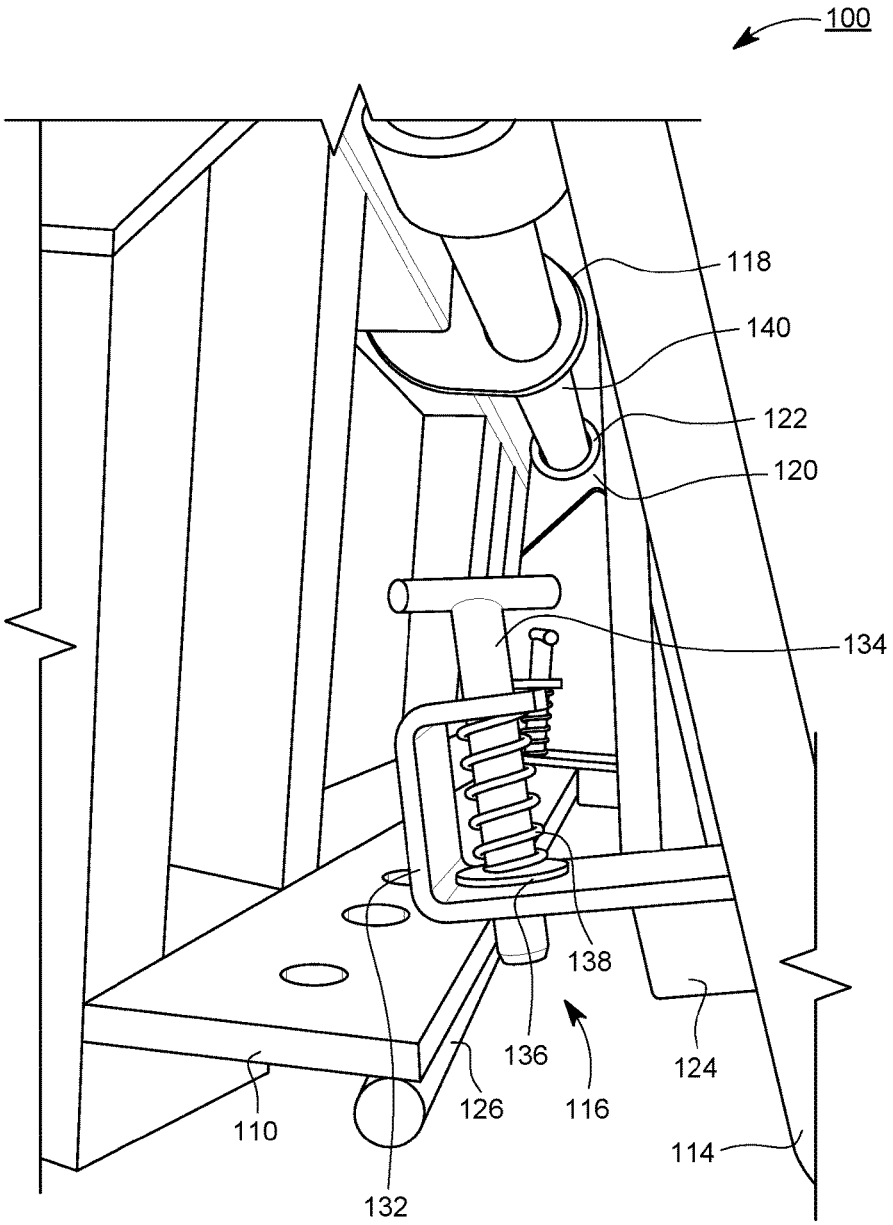
FIG. 4 depicts a right bottom perspective view of a tine adjustment structure of the inventive skid loader attachment of FIG. 2.

FIG. 4 provides a better view of the tine support structures 120, and the slide shaft bushings 122, as well as detailed views of the constraint structures 116. Preferably, the constraint structure 116, includes at least, but is not limited to: a confinement pin frame 132, secured to the tine 114 and the tine standoff 124; a confinement pin 134, captured by the confinement pin frame 132, and engaged with the tine adjustment structure 110; a retention flange 136, attached to the confinement pin 134; and a force member 138, disposed within the frame, and surrounding the confinement pin 134, the force member 138 maintains the engagement of the confinement pin 134 with the tine adjustment structure 110 during operation of the tine 114.

In a preferred embodiment, as shown by FIG. 4, the slide shaft 108, includes at least, but is not limited to: a round shaft 140, communicating with the pair of slide shaft bushings 122; a fixed slide restraint 142 (shown by FIG. 2) secured to a first slide shaft support flange of the pair of slide shaft support flanges 104 and confining a proximal end of the round shaft 140; and a removable slide restraint 144 (shown by FIG. 3) secured to a second slide shaft support flange of the pair of slide shaft support flanges 104 and confining a distal end of the round shaft 140.

Figure 5:
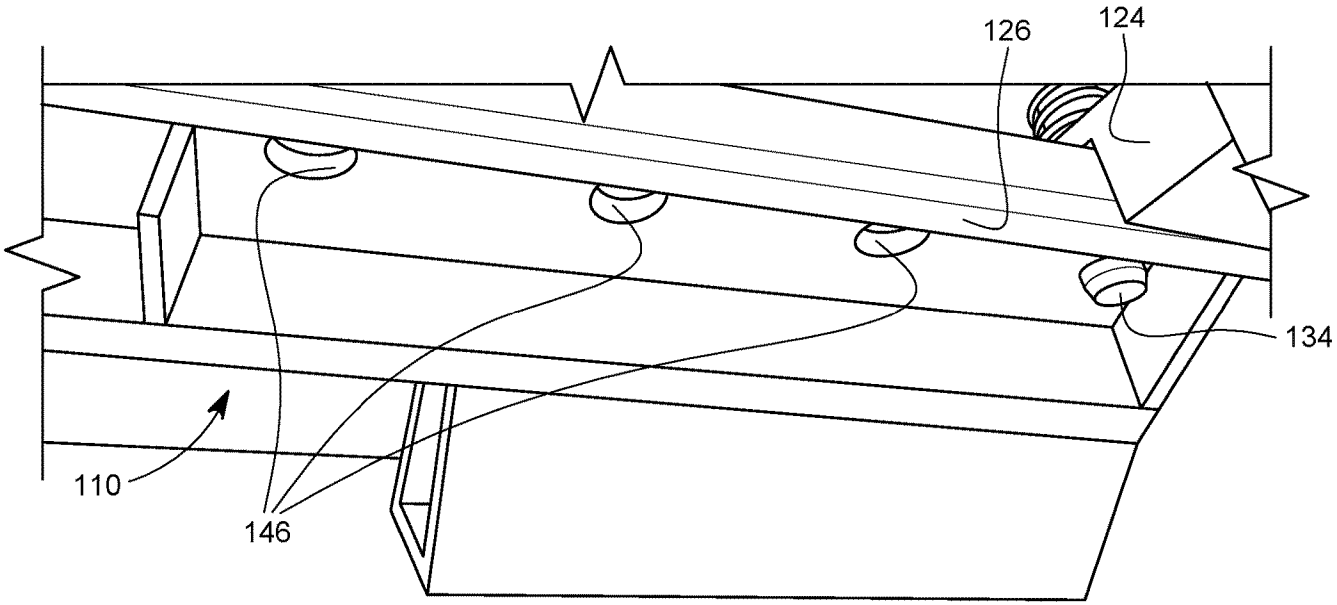
FIG. 5 illustrates a left bottom perspective view of the tine adjustment structure of the inventive skid loader attachment of FIG. 2.

FIG. 5 shows the relationship between: the tine standoff 124 and the buck rail 126; and the alignment apertures 146, of the constraint structure 110, with the confinement pin 134.

Figure 6:
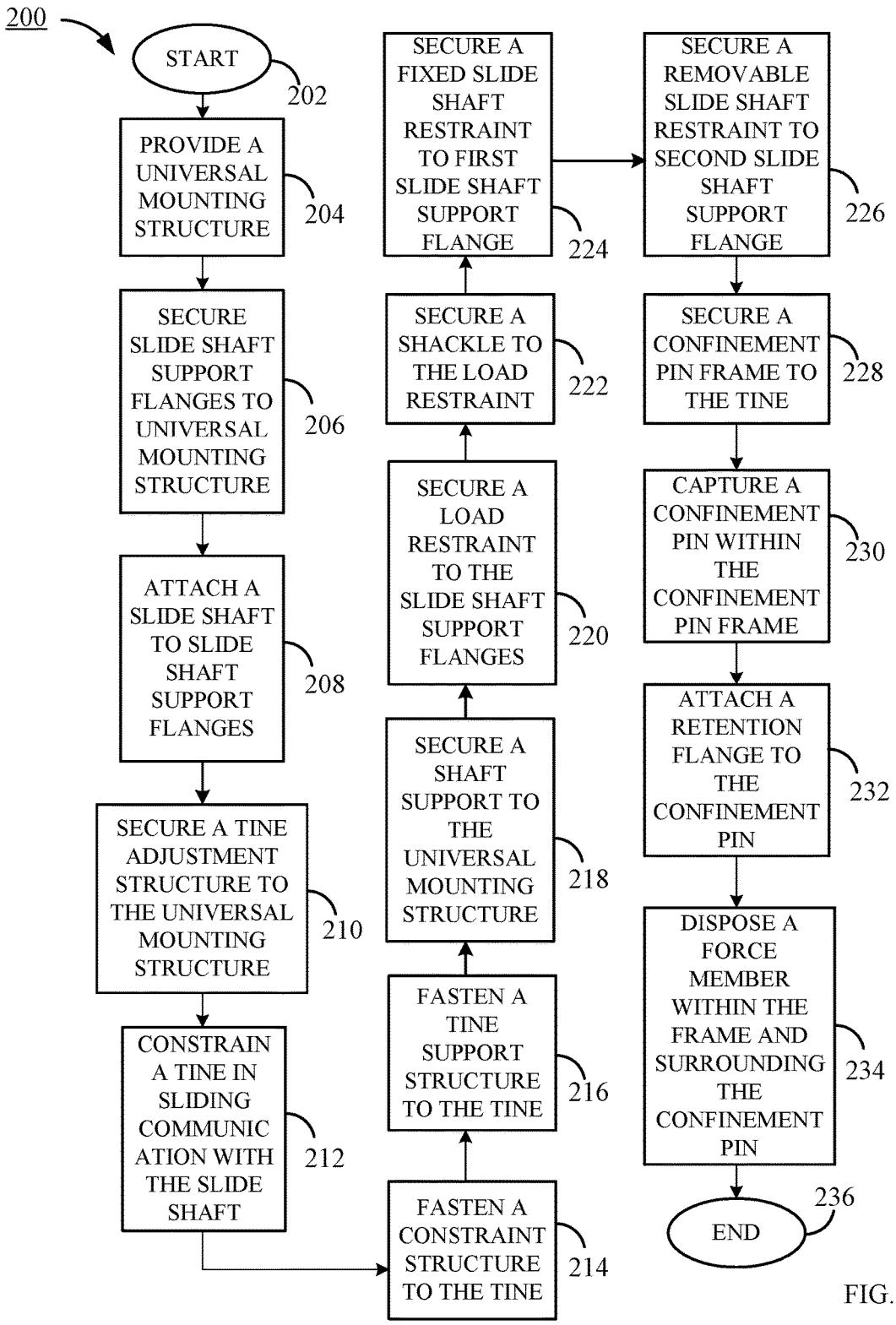
FIG. 6 is a block diagram of a method of making the apparatus of FIG. 2.

FIG. 6 shows a flow chart 200, of a method of making a skid loader attachment, such as 100. The method steps begin with start step 202 and continue with process step 204, where a universal mounting structure, such as 102, is provided. At process step 206, a pair of slide shaft support flanges, such as 104, are secured to the universal mounting structure, preferably at a proximal end 106 of the universal mounting structure, while at process step 208, a slide shaft such as 108 is attached to the pair of slide shaft support flanges.

The process continues at process step 210, with the securement of a tine adjustment structure, such as 110, to the distal end 112 of the universal mounting structure. Preferably, the tine adjustment structure protrudes horizontally from the universal mounting structure. At process step 212, at least one tine, such as 114, is constrained in sliding communication with the slide shaft. Preferably, a pair of constraint structures, such as 116 (which preferably cooperate with the tine adjustment structures and support a pair of tine standoffs, such as 124) are fastened to the at least one tine at process step 214. Preferably, the tine standoffs are in sliding, contact adjacency with a buck rail, such as 126. At process step 216, a tine support structure, such as 120 (which in a preferred embodiment includes a slide shaft bushing, such as 122, mounting for sliding communication with the slide shaft), is fastened to the at least one tine, and a shaft support structure, such as 118, is secured to the universal mounting structure at process step 218.

Continuing at process step 220, a load restraint, such as 128, is secured to the pair of slide shaft support flanges, and a shackle, such as 130, is secured to the load restraint at process step 222. At process step 224, a fixed slide shaft restraint, such as 142, is secured to a first of the pair of slide shaft support flanges, while a removable slide shaft restraint, such as 144, is secured to the second of the pair of slide shaft flanges at process step 226. At process step 228, a confinement pin frame, such as 132, is secured to the tine. At process step 230, a confinement pin, such as 134, is captured within the confinement pin frame, and a retention flange, such as 136, is attached to the confinement pin at process step 232. At process step 234, a force member, such as 138, is disposed within the confinement pin frame such that it surrounds the confinement pin, and the process concludes at end process step 236.

It is to be understood that even though numerous characteristics and configurations of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular skid loader attachment without departing from the spirit and scope of the present invention.

What is claimed is:

1. A skid loader attachment comprising;

a universal mounting structure, the universal mounting structure comprising an upper portion, a lower portion, and a main body portion disposed between the upper and lower portions;

a pair of slide shaft support flanges secured to the upper portion of the universal mounting structure, each of the pair of slide shaft support flanges protruding slightly forward and in a vertical direction from the upper portion of the universal mounting structure, each slide support flange of the pair of slide support flanges secured to the upper portion of the universal mounting structure only, having an absence of contact with either the lower portion, or the main body portion, of the universal mounting structure;

a slide shaft attached to, and disposed between, the pair of slide shaft support flanges, the slide shaft spaced apart from, and in non-contact adjacency with, the upper portion of the universal mounting structure;

a tine adjustment structure secured to the lower portion of the universal mounting structure, the tine adjustment member protruding in a horizontal direction from the lower portion of the universal mounting structure, the tine adjustment structure extends continuously across a front face of the lower portion of the universal mounting structure;

a load restraint secured to the pair of slide shaft support flanges, the load restraint extending vertically from the pair of slide shaft support flanges, the load restraint precludes a load supported by the tine from encroaching on a cockpit of the skid loader; and a shackle secured to the load restraint, the load restraint secures a position of the shackle relative to a midline of the universal mounting structure and in a forward position relative to the slide shaft.

2. The skid loader attachment of claim 1, further comprising a tine constrained by, and in sliding communication with, the slide shaft, the tine comprising a vertical portion and a horizontal portion, the horizontal portion protruding in a horizontal plane from the vertical portion, the vertical portion having an upper region and a lower region, the horizontal portion protruding from the lower region of the vertical portion of the tine.

3. The skid loader attachment of claim 2, further comprising a constraint structure fastened to the lower region of the vertical portion of the tine, the constraint structure cooperating with the tine adjustment structure, the constraint structure secures a position of the tine relative to a midline of the universal mounting structure.

4. The skid loader attachment of claim 3, further comprising a tine support structure fastened to the upper region of the vertical portion of the tine, the tine support structure cooperating with the slide shaft, the tine support structure in sliding communication with the slide shaft, the tine support structure secures the tine to the slide shaft.

5. The skid loader attachment of claim 1, further comprising a shaft support secured to the universal mounting structure, the shaft support surrounding the slide shaft.

6. The skid loader attachment of claim 1, further comprising:

a pair of tines constrained by the slide shaft, each of the pair of tines in sliding contact with the tine adjustment structure; and a pair of slide shaft bushings, each slide shaft bushing of the pair of slide shaft bushings secured to a corresponding tine of the pair of tines.

7. The skid loader attachment of claim 6, in which the slide shaft comprising:

a round shaft communicating with the pair of slide shaft bushings;

a fixed, slide restraint secured to a first slide shaft support flange of the pair of slide shaft support flanges, the fixed, slide shaft restraint confines a first end of the round shaft; and a removable, slide restraint removably attached to a second slide shaft support flange of the pair of slide shaft support flanges, the removable, slide restrain, when attached to the second slide shaft support flange, confines a second end of the round shaft, the second end of the round shaft distal from the first end of the round shaft.

8. The skid loader attachment of claim 7, further comprising a constraint structure secured to the tine and communicating with the tine adjustment structure, the constraint structure maintains a preselected lateral position of the tine relative to the tine adjustment structure.

9. The skid loader attachment of claim 8, in which the constraint structure comprising;

a confinement pin frame secured to the tine;

a confinement pin, captured by the confinement pin frame, engaged with the tine adjustment structure;

a retention flange attached to the confinement pin; and a force member disposed within the confinement pin frame, and surrounding the confinement pin, the force member maintains the engagement of the confinement pin with the adjustment structure during operation of the tine.

10. A skid loader attachment comprising;

a universal mounting structure, the universal mounting structure comprising an upper portion, a lower portion, and a main body portion disposed between the upper and lower portions;

a pair of slide shaft support flanges secured to the upper portion of the universal mounting structure, each of the pair of slide shaft support flanges protruding slightly forward and in a vertical direction from the upper portion of the universal mounting structure, each slide support flange of the pair of slide support flanges secured to the upper portion of the universal mounting structure only, having an absence of contact with either the lower portion, or the main body portion, of the universal mounting structure;

a slide shaft attached to, and disposed between, the pair of slide shaft support flanges, the slide shaft spaced apart from, and in non-contact adjacency with, the upper portion of the universal mounting structure;

a tine adjustment structure secured to the lower portion of the universal mounting structure, the tine adjustment member protruding in a horizontal direction from the lower portion of the universal mounting structure, the tine adjustment structure extends continuously across a front face of the lower portion of the universal mounting structure;

a load restraint secured to the pair of slide shaft support flanges, the load restraint extending vertically from the pair of slide shaft support flanges, the load restraint precludes a load supported by the tine from encroaching on a cockpit of the skid loader; and a shackle secured to the load restraint, the load restraint secures a position of the shackle relative to a midline of the universal mounting structure and in a forward position relative to the slide shaft.

11. The skid loader attachment of claim 10, further comprising a tine constrained by, and in sliding communication with, the slide shaft, the tine comprising a vertical portion and a horizontal portion, the horizontal portion protruding in a horizontal plane from the vertical portion, the vertical portion having an upper region and a lower region, the horizontal portion protruding from the lower region of the vertical portion of the tine.

12. The skid loader attachment of claim 11, further comprising a constraint structure fastened to the lower region of the vertical portion of the tine, the constraint structure cooperating with the tine adjustment structure, the constraint structure secures a position of the tine relative to a midline of the universal mounting structure.

13. The skid loader attachment of claim 12, further comprising a tine support structure fastened to the upper region of the vertical portion of the tine, the tine support structure cooperating with the slide shaft, the tine support structure in sliding communication with the slide shaft, the tine support structure secures the tine to the slide shaft.

14. The skid loader attachment of claim 10, further comprising:

a pair of tines constrained by the slide shaft, each of the pair of tines in sliding contact with the tine adjustment structure; and a pair of slide shaft bushings, each slide shaft bushing of the pair of slide shaft bushings secured to a corresponding tine of the pair of tines.

15. The skid loader attachment of claim 14, in which the slide shaft comprising:

a round shaft communicating with the pair of slide shaft bushings;

a fixed, slide restraint secured to a first slide shaft support flange of the pair of slide shaft support flanges, the fixed, slide shaft restraint confines a first end of the round shaft; and a removable, slide restraint removably attached to a second slide shaft support flange of the pair of slide shaft support flanges, the removable, slide restrain, when attached to the second slide shaft support flange, confines a second end of the round shaft, the second end of the round shaft distal from the first end of the round shaft.

16. The skid loader attachment of claim 15, further comprising a constraint structure secured to the tine and communicating with the tine adjustment structure, the constraint structure maintains a preselected lateral position of the tine relative to the tine adjustment structure.

17. The skid loader attachment of claim 16, in which the constraint structure comprising;

a confinement pin frame secured to the tine;

a confinement pin, captured by the confinement pin frame, engaged with the tine adjustment structure;

a retention flange attached to the confinement pin; and a force member disposed within the confinement pin frame, and surrounding the confinement pin, the force member maintains the engagement of the confinement pin with the adjustment structure during operation of the tine.

* * * * *